US008167388B2

(12) United States Patent
Hämmerle

(10) Patent No.: US 8,167,388 B2
(45) Date of Patent: May 1, 2012

(54) PULL-OUT GUIDE ASSEMBLY FOR A DRAWER

(75) Inventor: Hermann Hämmerle, Lustenau (AT)

(73) Assignee: Julius Blum GmbH, Hochst (AT)

( * ) Notice: Subject to any disclaimer, the term of this patent is extended or adjusted under 35 U.S.C. 154(b) by 315 days.

(21) Appl. No.: 12/385,699

(22) Filed: Apr. 16, 2009

(65) Prior Publication Data

US 2009/0232426 A1 Sep. 17, 2009

Related U.S. Application Data

(63) Continuation of application No. PCT/AT2007/000413, filed on Aug. 30, 2007.

(30) Foreign Application Priority Data

Oct. 18, 2006 (AT) ..... A 1734/2006

(51) Int. Cl.
*A47B 88/00* (2006.01)

(52) U.S. Cl. ..... 312/334.6; 312/334.15; 312/334.13

(58) Field of Classification Search ..... 312/334.15–334.18, 334.25, 334.26, 312/334.33, 334.36–334.39, 334.45, 334.9, 312/334.11–334.13, 334.6, 334.7; 384/18, 384/19

See application file for complete search history.

(56) References Cited

U.S. PATENT DOCUMENTS

| | | | | |
|---|---|---|---|---|
| 3,937,531 | A | 2/1976 | Hagen et al. | |
| 5,577,821 | A * | 11/1996 | Chu | 312/334.11 |
| 6,986,557 | B2 * | 1/2006 | Kellenberger et al. | 312/334.11 |
| 2003/0197452 | A1 * | 10/2003 | Kung | 312/334.6 |
| 2004/0000851 | A1 * | 1/2004 | Lam Harn et al. | 312/334.7 |
| 2005/0174021 | A1 * | 8/2005 | Blum et al. | 312/334.13 |
| 2005/0231083 | A1 * | 10/2005 | Garcie, Jr. | 312/333 |
| 2006/0097609 | A1 * | 5/2006 | Milligan et al. | 312/319.1 |
| 2007/0057608 | A1 * | 3/2007 | Chiu | 312/334.1 |
| 2008/0284299 | A1 * | 11/2008 | Chen et al. | 312/332 |

FOREIGN PATENT DOCUMENTS

| | | |
|---|---|---|
| AT | 365 433 | 1/1982 |
| GB | 2122274 | 1/1984 |

OTHER PUBLICATIONS

Austrian Search Report issued May 4, 2007 in the corresponding Austrian application.

* cited by examiner

*Primary Examiner* — Darnell Jayne
*Assistant Examiner* — Andres F Gallego
(74) *Attorney, Agent, or Firm* — Wenderoth, Lind & Ponack, L.L.P.

(57) ABSTRACT

A pull-out guide for drawers including a first rail and at least one second rail, and at least one carriage is arranged between the two rails. The carriage includes a bearing group containing load-transmitting elements, preferably rollers, rolling bodies and/or balls. The load-transmitting elements guide the bearing group in the vertical direction and in the horizontal direction. At least one additional load-transmitting element is arranged on a bracket, at a distance from the bearing group. When the second rail is pulled out, the additional load-transmitting element can at least partially move out over the end of the first rail, such that it no longer lies on the first rail.

18 Claims, 5 Drawing Sheets

PULL-OUT GUIDE ASSEMBLY FOR A DRAWER

This application is a continuation of International Application No. PCT/AT2007/000413, filed Aug. 30, 2007.

BACKGROUND OF THE INVENTION

The present invention relates to a pull-out guide assembly for a drawer comprising a first rail and at least one second rail. Arranged between those two rails is at least one running carriage having a bearing group with load-transmitting elements, preferably rollers, rolling bodies and/or balls. The load-transmitting elements guide the bearing group both in a vertical and also in a horizontal direction.

The invention further concerns a running carriage of such a pull-out guide assembly and an article of furniture with a pull-out guide assembly of the type to be described.

Pull-out guide assemblies for drawers of that kind can be both in the form of a single extension with a support rail to be mounted on the body of the article of furniture and a pull-out rail to be mounted on opposite sides of the drawer. The guide assemblies can also be in the form of a full extension guide assembly in which a middle rail is disposed between the pull-out rail rails and the support rails. The pull-out guide assemblies permit smooth running of the drawer or a compartment shelf with a high level of load-bearing capacity. In the closed condition of the drawer, particularly when a high level of loading is involved, the foremost load-transmitting elements of the running carriage displaceable between the rails are considerably loaded. If plastic rollers are employed as load-transmitting elements, those rollers can suffer deformation with time and as a result detrimentally affect the running characteristics of the pull-out guide assembly.

AT 365 433 discloses a full extension guide for drawers, wherein a carriage is arranged between the support rail associated with the body of the article of furniture and the middle rail. In the displacement travel of the rails, a rolling body associated with the carriage is movable beyond the end of the support rail.

U.S. Pat. No. 3,937,531 discloses a telescopic extension means for drawers, wherein a roller sliding bearing is arranged between the rails. In the closed position of the rails, all rollers bear against the support rail, while in the opening movement some rollers can be brought out of engagement from the support rail.

It is therefore an object of the present invention to propose a pull-out guide assembly of the general kind set forth in the opening part of this specification, having an improved durability and functionality.

SUMMARY OF THE INVENTION

The object of the invention is achieved in that there is provided at least one additional load-transmitting element arranged at a cantilever arm at a spacing relative to the bearing group. The additional load-transmitting element upon extension of the second rail can be moved at least region-wise beyond the end of the first rail so that it no longer bears against the first rail.

Those additional (closed-support) load-transmitting elements which in the movement of the rail system can be moved beyond the front end of the first rail (and which are desirably arranged as the foremost load-transmitting elements of the carriage in the extension direction of the rails) preferably serve only for supporting the drawer in the closed position. In the closed condition of the drawer, the additional (closed-support) load-transmitting element is most heavily loaded and takes up—at least partially—the load from the other remaining load-transmitting elements (which are supposed to serve as actual rolling bodies during the displacement movement of the rails). Besides improved load distribution, that provides that those additional load-transmitting elements which can overrun the front end of the first rail are subjected to flattening or deformation. However, the deformation is irrelevant, as these additional elements no longer operate as actual rolling members of the pull-out guide assembly during displacement of the drawer. In this connection, the at least one load-transmitting element rests on the first rail in the closed position of the rails and is out of engagement from the first rail in an open position of the second rail.

In accordance with a preferred embodiment of the invention, the cantilever arm is arranged in the axial direction of the carriage and in the extension direction of the rails.

In accordance with this aspect of the present invention, a standard carriage is provided with a cantilever arm pointing in the axial direction of the carriage. By means of such a construction, the spacing between the foremost axis and the rearmost axis of the rolling bodies of the carriage is also increased, which results in an improved load distribution for the drawer. In accordance with a further embodiment of the invention, it can also be provided that the cantilever arm can be coupled by a releasable fastening device with respect to the running carriage (for example with a coupling part) so that optionally cantilever arms of different lengths can be coupled to a carriage cage.

BRIEF DESCRIPTION OF THE DRAWINGS

Further details of the invention will now be described with reference to the specific description hereinafter, in which.

DETAILED DESCRIPTION OF THE INVENTION

Figure 1:
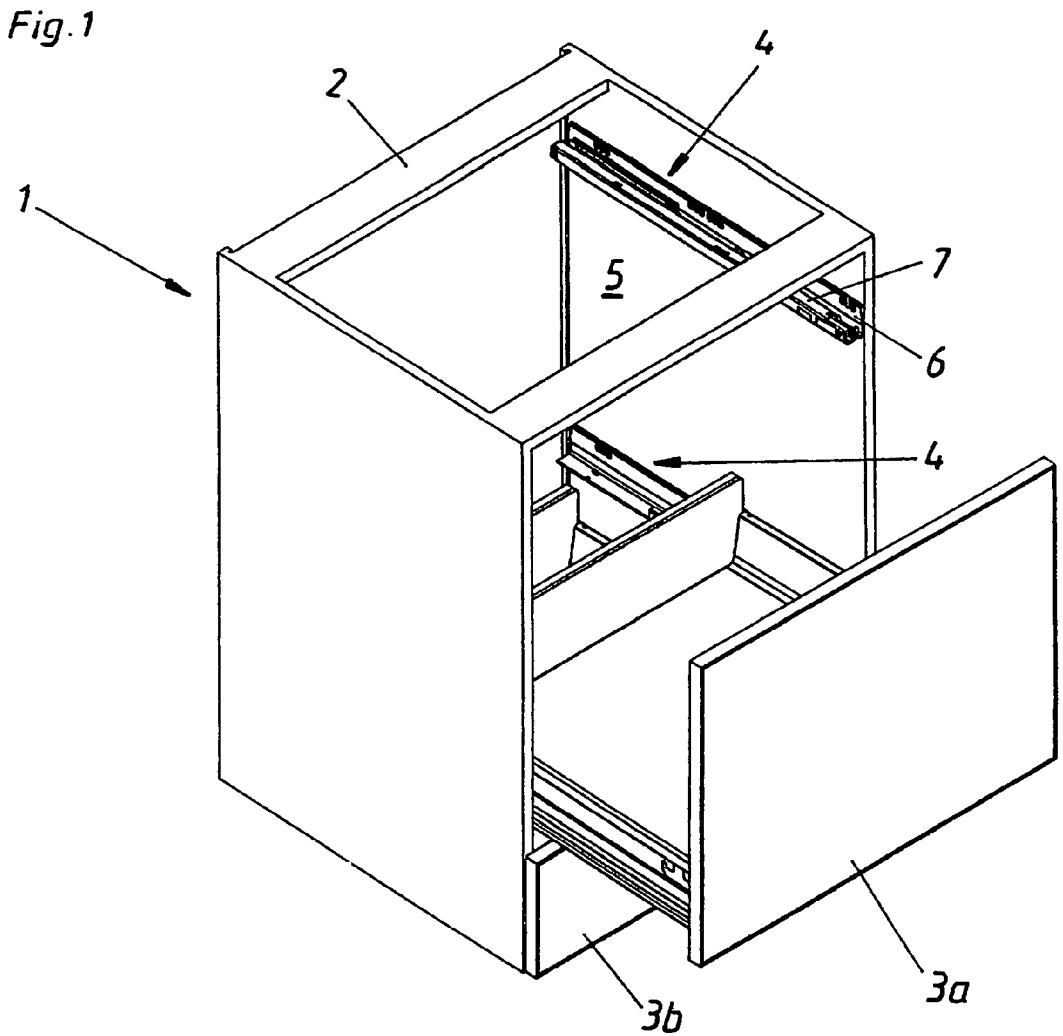
FIG. 1 shows a perspective view of an article of furniture in cabinet form, with drawers which are mounted displaceably on pull-out guide assemblies according to the invention.

FIG. 1 shows an article of furniture 1 in the form of a cabinet having a furniture body 2, wherein drawers 3*a* and 3*b* are guided displaceably therein by way of pull-out guide assemblies 4 according to the invention. The pull-out guide assemblies 4 are preferably fixed on both opposite side walls 5 of the furniture body 2 and can be in the form of a single extension guide assembly having a first rail 6 and a second rail 7, or also in the form of a differential extension guide assembly having three rails, wherein the illustrated rail 7 takes over the function of the middle rail which is displaceably guided between the stationary first rail 6 and a pull-out rail 7 associated with the drawer.

Figure 2:
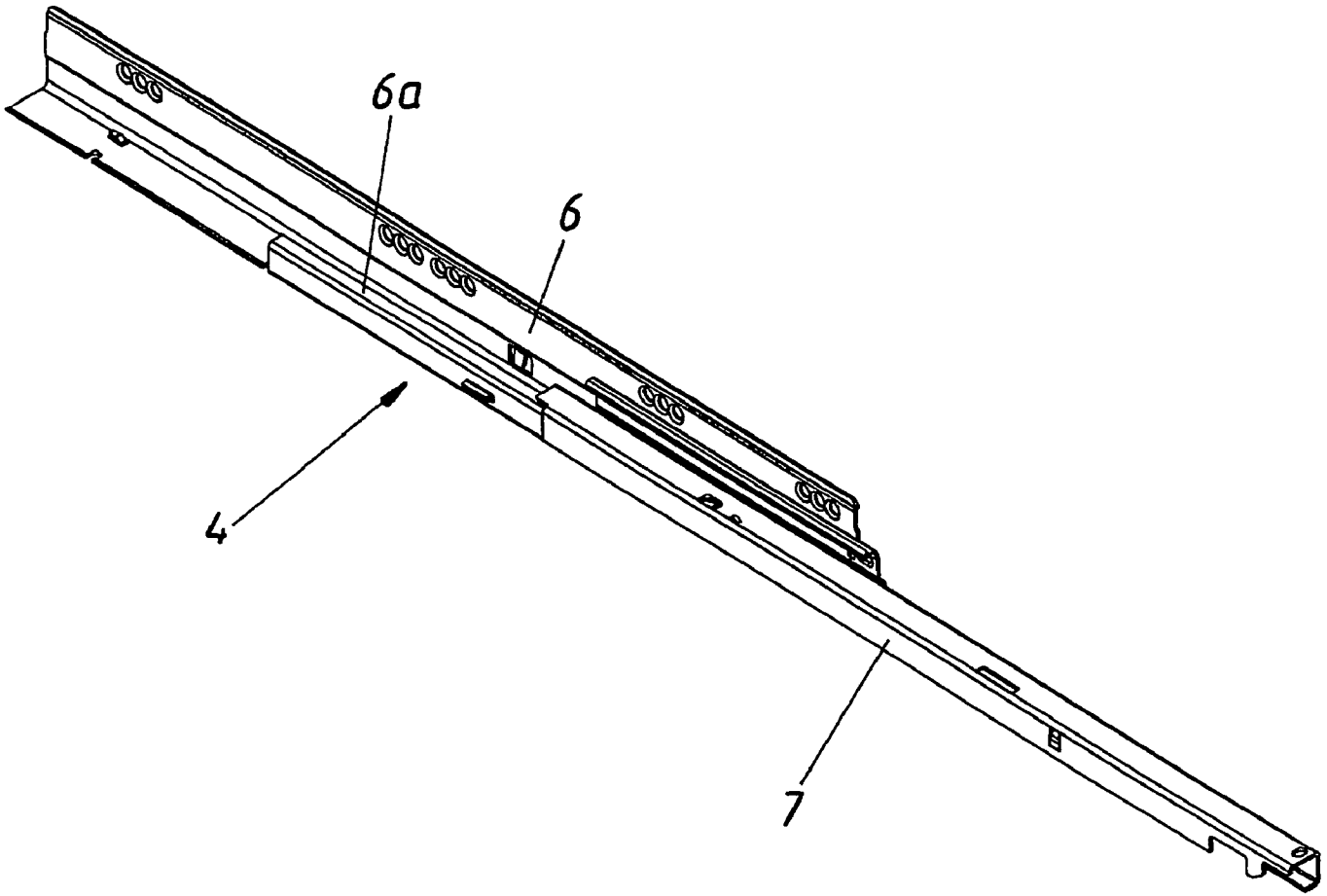
FIG. 2 shows a perspective view of a pull-out guide assembly in an open position.

FIG. 2 shows a pull-out guide assembly 4 for drawers 3*a*, 3*b* according to the invention, wherein the first rail 6 represents the support rail which is fixed with respect to the body of furniture and the second rail 7 is associated with the drawer 3*a* or 3*b*. The second rail 7 is mounted displaceably relative to the first rail 6. The first rail 6 has a running limb 6*a* against which a carriage, which is still to be described, can be caused to bear. In the figure shown, the illustrated pull-out guide assembly 4 is in an open position.

Figure 3:
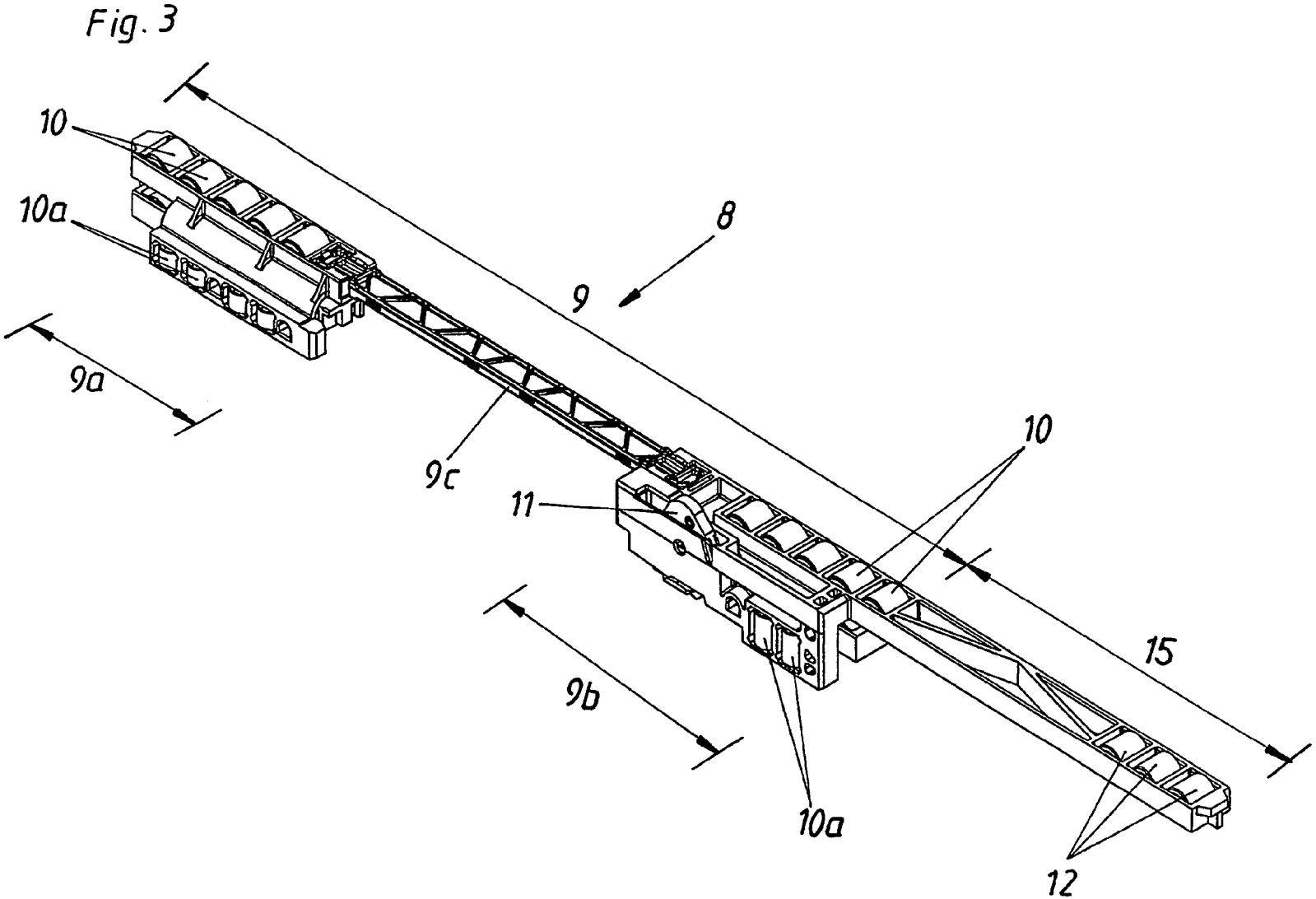
FIG. 3 shows a perspective view of a running carriage in accordance with the invention.

FIG. 3 shows an embodiment of a carriage 8 in accordance with an aspect of the invention, and the carriage 8 is guided displaceably between the first rail 6 (FIG. 2) and the second rail 7 and is provided for transmission of the load of the drawer 3*a*, 3*b*. The running carriage 8 comprises a carriage cage 9 with at least two mutually spaced bearing groups 9*a* and 9*b* which are connected together by a limb 9*c*. The length of the limb 9*c* can vary according to the respective length of the rails 6 and 7 (that is to say, long rails 6 and 7 require longer carriages 8 or limbs 9*c*, while shorter carriages 8 or limbs 9*c* are provided for short rails 6 and 7). The first and second bearing groups 9*a* and 9*b* are constantly in contact with the first rail 6 both in the closed position of the second rail 7 and also in the open position thereof. For that purpose, the bearing groups 9*a* and 9*b* have a first group of load-transmitting elements 10 with horizontal axes of rotation (for guiding the bearing group in a vertical direction) and also a second group of load-transmitting elements 10*a* whose axes of rotation at least in part differ from the horizontal and are preferably vertical (for guiding the bearing group in a lateral direction). The inclination of the axes of rotation of the load-transmitting elements 10*a* depends on the configuration or angular position of the running limb 6*a*, shown in FIG. 2, of the first rail 6. The running carriage 8 further comprises a control cam 11 which is known in accordance with the state of the art and which is provided to correct so-called carriage running errors which are a result of slippage of the running carriage 8 with respect to the rails of an at least three-part rail system. The function and configuration of the control cam 11 is not referred to in greater detail in the context of the present invention. Essential is the fact that the running carriage 3 comprises a cantilever arm portion 15 at its front face (i.e., forward of the bearing groups 9*a* and 9*b* with respect to the opening direction) which extends in an axial direction of the carriage 3 and in an opening direction of the rails 6, 7. The cantilever arm 15 comprises a third group of preferably three additional load-transmitting elements 12 with horizontal axes of rotation. Those additional closed-support load-transmitting elements 12 of the cantilever arm 15 rest on the rail associated with the body of furniture in a closed position of the rails 6 and are subjected—in the closed position—to a higher load than the other remaining (first and second group) load-transmitting elements 10 of the actual carriage cage 9. As such, premature flattening of the remaining (first and second group) load-transmitting elements 10 of both bearing groups 9*a*, 9*b* can be avoided. The additional closed-support load-transmitting elements 12 of the cantilever arm 15, however, can overrun the front end of the first rail when the second rail is being pulled out so that the additional closed-support load-transmitting elements 12 of the cantilever arm 15 no longer rest on the first rail 6 in an open position of the rails 6, 7.

Figures 4A, 4B, 4C:
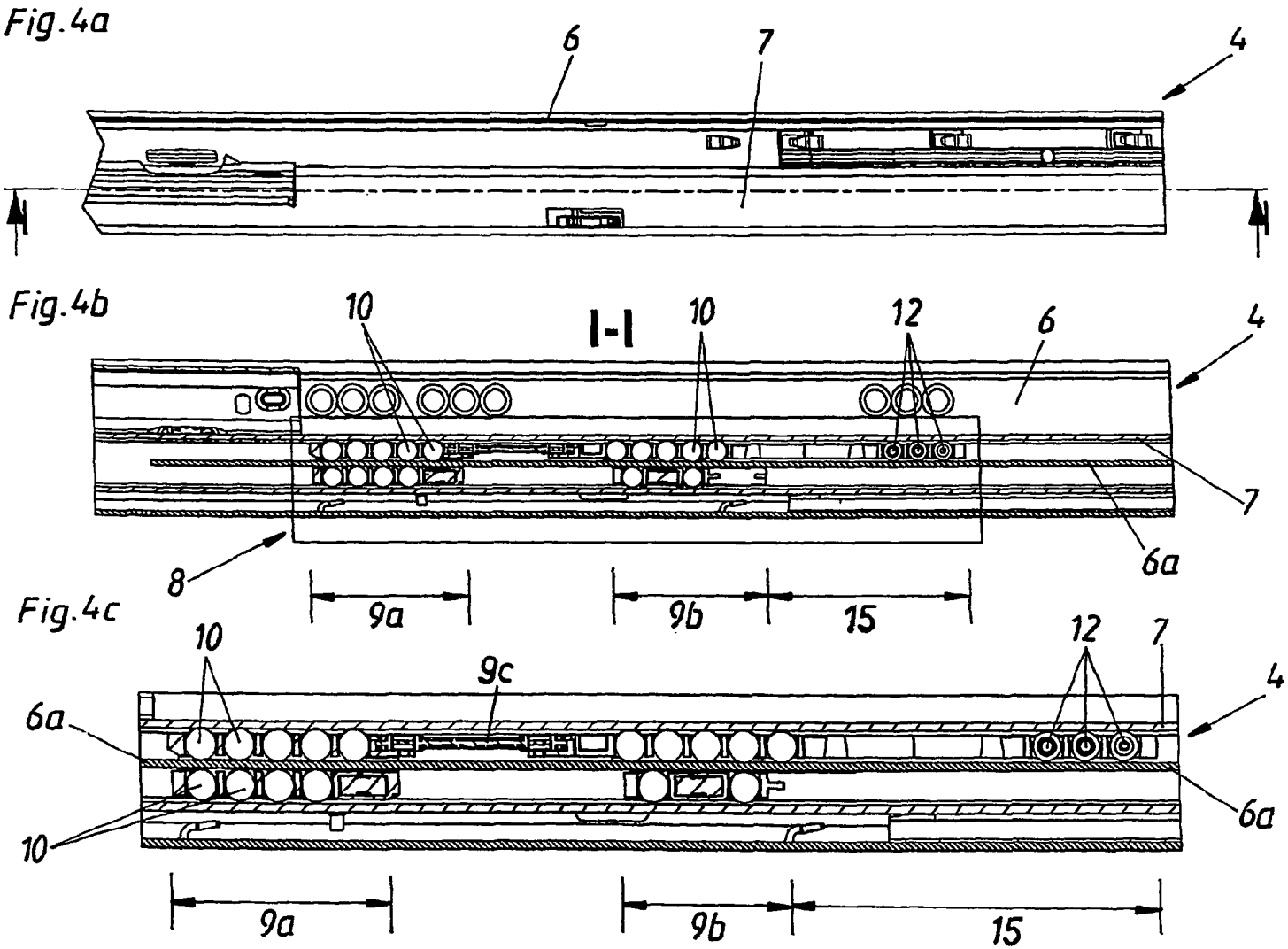
FIG. 4*a*-4*c* show various detail views of a pull-out guide assembly in the closed position.

FIG. 4*a*-4*c* show various views of the foremost region of the pull-out guide assembly 4 in the closed position. FIG. 4*a* shows a top plan view of the closed pull-out guide assembly 4 with the first rail 6 to be fixed to the body of furniture 2 (FIG. 1) and with the second rail 7 to be mounted to the drawer 3*a*, 3*b* (FIG. 1).

FIG. 4*b* shows a vertical section of the pull-out guide assembly 4 along the plane I-I in FIG. 4*a*. To be seen is the carriage 8 which is displaceable between the rails 6 and 7 (disposed within the rectangular section), with its spaced bearing groups 9*a* and 9*b* and its cantilever arm 15, at the distal end of which the additional closed-support load-transmitting elements 12 are rotatably arranged. In the illustrated closed position of the rails 6, 7, the additional closed-support load-transmitting elements 12 of the cantilever arm 15 are supported against the horizontal portion of the running limb 6*a* of the first rail 6 associated with the body of furniture. The running limb 6*a* is constantly in contact with the load-transmitting elements 10 of the two bearing groups 9*a* and 9*b* on its top side and its underside.

FIG. 4*c* shows the rectangular detail illustrated in FIG. 4*b* on an enlarged scale. The horizontal load-transmitting elements 10 of the first and second bearing groups 9*a* and 9*b* embrace the horizontal running limb 6*a* of the first rail 6 associated with the body of furniture. In the illustrated closed condition of the rails 6, 7, the additional closed-support load-transmitting elements 12 of the cantilever arm 15 are supported against the top side of the horizontal running limb 6*a* and serve as additional support rollers.

Figures 5A, 5B, 5C:
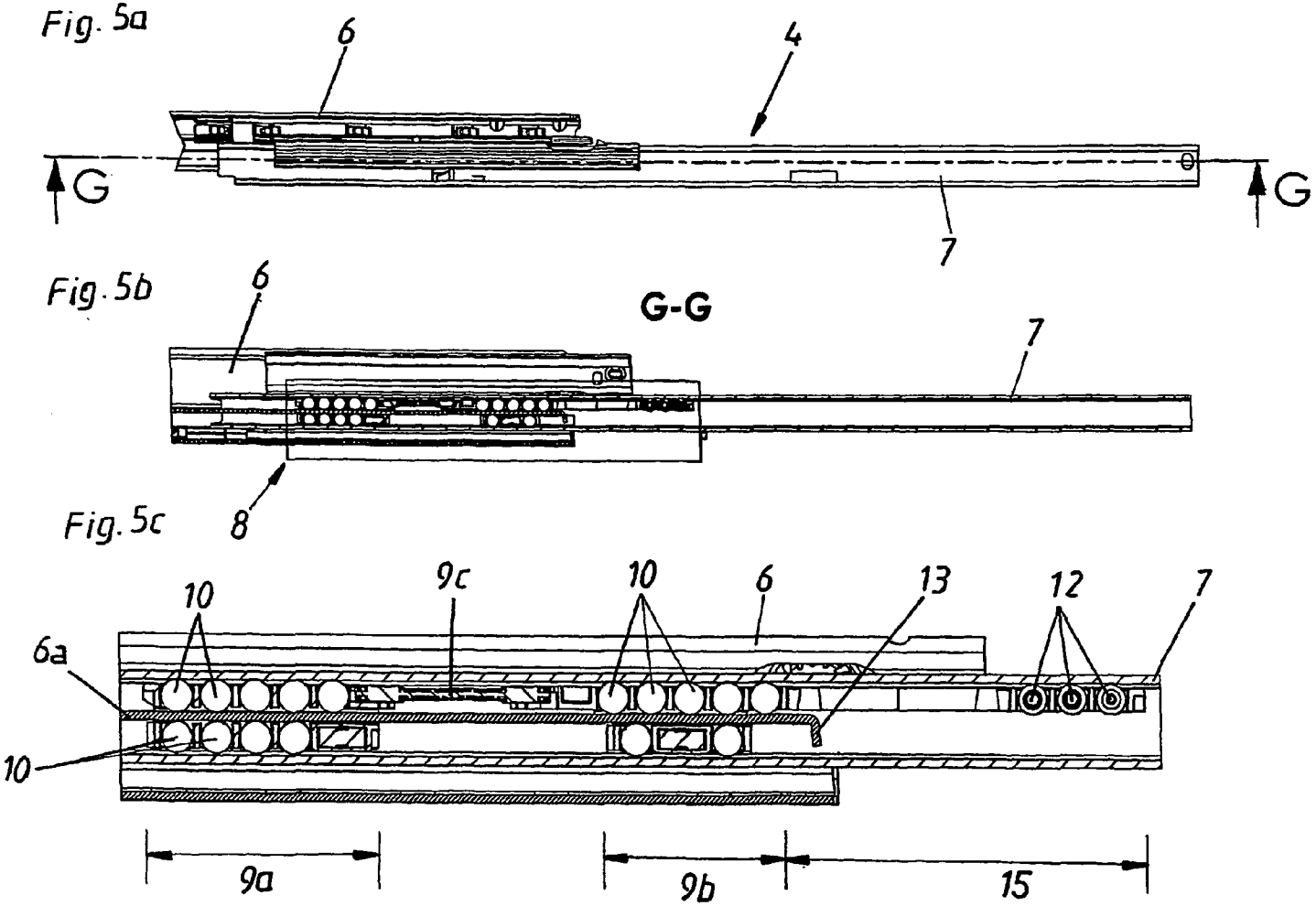
FIG. 5*a*-5*c* show various detail views of a pull-out guide assembly in the open position.

FIG. 5*a*-5*c* show similar views to FIG. 4*a*-4*c*, with the difference that the second rail 7 is in an open position. FIG. 5*a* shows a top plan view of the foremost region of the pull-out guide assembly 4, with the second rail 7 being in an open position with respect to the stationary rail 6.

FIG. 5*b* shows a vertical section along plane G-G in FIG. 5*a*, that is to say a sectional side view of the pull-out guide assembly 4.

FIG. 5*c* shows the rectangular detail illustrated in FIG. 5*b* on an enlarged scale (that is to say, an enlarged sectional side view of the pull-out guide assembly 4). As shown, the additional load-transmitting elements 12 of the cantilever arm 15 are no longer in contact with the first rail 6 associated with the body of furniture or the running limb 6*a* thereof, but have been extended beyond the end of the running limb 6*a* in the extension movement. The load-transmitting elements 10 of the two bearing groups 9*a* and 9*b* still contact the first rail 6, at both sides of the running limb 6*a*. The first rail 6 or the running limb 6*a* thereof has a diagrammatically illustrated inclined surface 13 in the front region—in the extension direction of the second rail 7. That inclined surface 13 serves to lift the additional closed-support load-transmitting elements 12 of the cantilever arm on to the top side of the running limb 6*a* with an easy movement when the second rail 7 is pushed in again. In the illustrated embodiment, the inclined surface 13 is in the form of an angled portion of the running limb 6*a*, but it is also possible to provide for an inclination of the running limb 6*a* as well as a separately arranged or formed run-on inclined surface for the additional load-transmitting elements 12.

The present invention is not limited to the illustrated embodiment by way of example, but embraces or extends to all variants and technical equivalents which can fall within the scope of the accompanying claims. The positional references adopted in the description such as for example top, bottom, lateral and so forth are related to the usual position of installation of the extension guide 4 or the immediately described and illustrated Figure and upon a change in position are to be appropriately converted to the new position.

The invention claimed is:

1. A pull-out guide assembly for a drawer, comprising:

a first rail and a second rail;

a running carriage arranged between said first rail and said second rail, said running carriage including a bearing group having load-transmitting elements, said load-transmitting elements being arranged to guide said running carriage in a vertical direction and in a lateral direction, said load-transmitting elements comprising a first group of load-transmitting elements each having an axis of rotation in a first plane and comprising a second group of load-transmitting elements each having an axis of rotation in a second plane not parallel to said first plane, said running carriage having a cantilever arm portion located forward of said bearing group with respect to an opening direction of said pull-out guide assembly; and a closed-support load-transmitting element arranged at said cantilever arm portion and spaced apart from said bearing group, said closed-support load-transmitting element comprising a roller, wherein said first rail, said second rail, said running carriage, and said closed-support load-transmitting element are configured such that, when said running carriage is in a fully closed position, said closed-support load-transmitting element rests on said first rail so as to support said running carriage, and such that, when said running carriage is in a fully open position, said cantilever arm portion of said running carriage protrudes beyond a forward end of said first rail so that said closed-support load transmitting element does not rest on said first rail.

2. The pull-out guide assembly according to claim 1, wherein said load-transmitting elements comprises at least one of rollers, rolling bodies, and balls.

3. The pull-out guide assembly according to claim 1, wherein said first rail, said second rail, said running carriage, and said closed support load-transmitting element are configured such that, when said running carriage is in the fully closed position, said closed-support load-transmitting element is supported by said first rail so as to support said running carriage, and such that, when said running carriage is in the fully open position, said cantilever arm portion of said running carriage protrudes beyond said forward end of said first rail so that said closed-support load transmitting element is disengaged from said first rail.

4. The pull-out guide assembly according to claim 1, wherein said closed-support load-transmitting element has a horizontal axis of rotation.

5. The pull-out guide assembly according to claim 1, wherein said closed-support load-transmitting element comprises one of a plurality of closed-support load-transmitting elements located at said cantilever arm portion, said closed-support load-transmitting elements being arranged such that, when said running carriage is in the fully open position, said cantilever arm portion of said running carriage protrudes beyond said forward end of said first rail so that none of said closed-support load transmitting elements rest on said first rail.

6. The pull-out guide assembly according to claim 5, wherein each of said closed-support load-transmitting elements has only a horizontal axis of rotation.

7. The pull-out guide assembly according to claim 1, wherein said cantilever arm portion extends in an axial direction of said running carriage and in an extension direction of said first rail and said second rail.

8. The pull-out guide assembly according to claim 1, wherein said cantilever arm portion has a latticework configuration.

9. The pull-out guide assembly according to claim 1, wherein said bearing group comprises a first bearing group having said first group of load-transmitting elements and said second group of load-transmitting elements, said running carriage further including a second bearing group spaced apart from said first bearing group in an axial direction of said running carriage, said second bearing group having a third group of load-transmitting elements and a fourth group of load-transmitting elements, said first group of load-transmitting elements, said second group of load-transmitting elements, said third group of load-transmitting elements, and said fourth group of load-transmitting elements being arranged such that, upon displacement of said first rail and said second rail, said first load-transmitting elements, said second load-transmitting elements, said third group of load-transmitting elements, and said fourth group of load-transmitting elements are constantly supported by said first rail regardless of a position of said running carriage.

10. The pull-out guide assembly according to claim 9, wherein each of said load-transmitting elements in said second group of said load-transmitting elements and said fourth group of said load-transmitting elements has an axis of rotation at least partially different from a horizontal axis.

11. The pull-out guide assembly according to claim 10, wherein each of said second group of said load transmitting elements and said fourth group of said load-transmitting elements has a vertical axis of rotation.

12. The pull-out guide assembly according to claim 10, wherein said first bearing group and said second bearing group are connected together by a limb, said cantilever arm portion with said closed-support load-transmitting element protrudes towards a front end of said pull-out guide assembly.

13. The pull-out guide assembly according to claim 1, wherein said first rail is a support rail to be mounted on a carcass of an article of furniture.

14. The pull-out guide assembly according to claim 13, wherein said second rail is a pull-out rail to be mounted on one of a drawer or a movable middle rail located between said support rail and said pull-out rail.

15. The pull-out guide assembly according to claim 1, wherein said first rail comprises an inclined surface at a front end region of said first rail, said inclined surface being configured to guide said closed-support load-transmitting element during movement of said running carriage in a closing direction.

16. The pull-out guide assembly according to claim 1, wherein said first rail, said second rail, said running carriage, and said closed support load-transmitting element are configured such that, when said running carriage is in the fully closed position, said closed-support load-transmitting element rests directly on said first rail so as to support said running carriage, and such that, when said running carriage is in the fully open position, said cantilever arm portion of said running carriage protrudes beyond said forward end of said first rail so that said closed-support load transmitting element does not rest on any rail.

17. An article of furniture comprising:

a furniture carcass;

a drawer movable with respect to said furniture carcass; and a pull-out guide assembly linking said drawer to said furniture carcass, said pull-out guide assembly including:

a first rail connected to said furniture carcass and a second rail connected to said drawer;

a running carriage arranged between said first rail and said second rail, said running carriage including a bearing group having load-transmitting elements, said load-transmitting elements being arranged to guide said running carriage in a vertical direction and in a lateral direction, said load-transmitting elements comprising a first group of load-transmitting elements each having an axis of rotation in a first plane and comprising a second group of load-transmitting elements each having an axis of rotation in a second plane not parallel to said first plane, said running carriage having a cantilever arm portion located forward of said bearing group with respect to an opening direction of said pull-out guide assembly; and a closed-support load-transmitting element arranged at said cantilever arm portion and spaced apart from said bearing group, said closed-support load-transmitting element comprising a roller, wherein said first rail, said second rail, said running carriage, and said closed-support load-transmitting element are configured such that, when said running carriage is in a fully closed position, said closed-support load-transmitting element rests on said first rail so as to support said running carriage, and such that, when said running carriage is in a fully open position, said cantilever arm portion of said running carriage protrudes beyond a forward end of said first rail so that said closed-support load-transmitting element does not rest on said first rail.

18. The article of furniture according to claim 17, wherein said first rail, said second rail, said running carriage, and said closed support load-transmitting element are configured such that, when said running carriage is in the fully closed position, said closed-support load-transmitting element rests directly on said first rail so as to support said running carriage, and such that, when said running carriage is in the fully open position, said cantilever arm portion of said running carriage protrudes beyond said forward end of said first rail so that said closed-support load transmitting element does not rest on any rail.

* * * * *